US006228785B1

(12) United States Patent
Miller et al.

(10) Patent No.: US 6,228,785 B1
(45) Date of Patent: May 8, 2001

(54) ROOFING MATERIAL HAVING IMPROVED IMPACT RESISTANCE

(75) Inventors: David George Miller, Pickerington; Carla A. Miller, Newark, both of OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/223,578

(22) Filed: Dec. 30, 1998

(51) Int. Cl.[7] ..... B32B 27/04

(52) U.S. Cl. ..... 442/148; 442/104; 442/167; 442/170; 442/171; 442/381; 442/389; 442/390

(58) Field of Search ..... 442/390, 167, 442/171, 170, 389, 381, 104, 148

(56) References Cited

U.S. PATENT DOCUMENTS

| | | | | |
|---|---|---|---|---|
| 3,813,280 | | 5/1974 | Olszyk et al. | 161/151 |
| 3,937,640 | | 2/1976 | Tajima et al. | 156/71 |
| 4,055,453 | | 10/1977 | Tajima et al. | 156/279 |
| 4,091,135 | | 5/1978 | Tajima et al. | 428/40 |
| 4,368,228 | | 1/1983 | Gorgati | 428/110 |
| 4,374,687 | | 2/1983 | Yamamoto | 156/71 |
| 4,420,524 | | 12/1983 | Gorgati | 428/110 |
| 4,529,625 | * | 7/1985 | Reindenbach et al. | 427/186 |
| 4,595,629 | * | 6/1986 | Mays | 428/286 |
| 4,599,258 | | 7/1986 | Hageman | 428/140 |
| 4,636,414 | | 1/1987 | Tajima et al. | 428/40 |
| 4,714,651 | | 12/1987 | Hartmann et al. | 428/286 |
| 4,957,806 | | 9/1990 | Pangrazi et al. | 428/224 |
| 5,082,720 | * | 1/1992 | Hayes | 428/224 |
| 5,100,715 | | 3/1992 | Zimmerman et al. | 428/147 |
| 5,195,290 | | 3/1993 | Hulett | 52/518 |
| 5,326,797 | | 7/1994 | Zimmerman et al. | 524/59 |
| 5,456,785 | | 10/1995 | Venable | 156/229 |
| 5,488,807 | | 2/1996 | Terrenzio et al. | 52/555 |
| 5,508,093 | * | 4/1996 | Mehdorn | 428/219 |
| 5,525,413 | | 6/1996 | Daurer et al. | 428/247 |
| 5,569,430 | | 10/1996 | Callaway et al. | 264/258 |
| 5,571,596 | | 11/1996 | Johnson | 428/143 |
| 5,580,638 | | 12/1996 | Kiser | 428/143 |
| 5,593,766 | | 1/1997 | Woiceshyn | 428/236 |
| 5,822,943 | | 10/1998 | Frankoski et al. | 52/518 |
| 5,972,463 | * | 10/1999 | Martin et al. | 428/95 |

FOREIGN PATENT DOCUMENTS

| | | |
|---|---|---|
| 0208918 | 1/1987 | (EP) . |
| 260 494 A1 | 3/1988 | (EP) . |
| 0441241 | 8/1991 | (EP) . |
| 0573363 | 12/1993 | (EP) . |
| 0668392 | 8/1995 | (EP) . |
| 2 720 772 | 12/1995 | (FR) . |
| WO 97 00362 | 1/1997 | (WO) . |

OTHER PUBLICATIONS

Ellis, Roger L., et al., "Ballistic Impact Resistance of SMA and Spectra Hybrid Graphite Composities." *Journal of Reinforced Plastics and Composites*, vol. 17, No. 2, (1998), pp. 147–164.

* cited by examiner

*Primary Examiner*—Terrel Morris
*Assistant Examiner*—Norca L. Torres
(74) *Attorney, Agent, or Firm*—Inger H. Eckert; James J. Dottavio

(57) ABSTRACT

An asphalt-based roofing material includes a substrate coated with an asphalt coating. The asphalt coating includes a lower region that is positioned below the substrate when the roofing material is installed on a roof. A web is fused to the lower region of the asphalt coating. A portion of the web and of the asphalt coating have been intermingled by melting, thereby fusing the web and the asphalt coating. A method of manufacturing the asphalt-based roofing material includes the steps of coating a substrate with an asphalt coating, applying a web to the lower region of the asphalt coating, and intermingling a portion of the web and of the asphalt coating by melting, thereby fusing the web to the lower region of the asphalt coating.

32 Claims, 6 Drawing Sheets

ROOFING MATERIAL HAVING IMPROVED IMPACT RESISTANCE

TECHNICAL FIELD AND INDUSTRIAL APPLICABILITY OF THE INVENTION

This invention relates to asphalt-based roofing materials, and in particular to an asphalt-based roofing material including a web that is positioned and bonded in such a manner as to provide the roofing material with improved impact resistance.

BACKGROUND OF THE INVENTION

Asphalt-based roofing materials, such as roofing shingles, roll roofing and commercial roofing, are installed on the roofs of buildings to provide protection from the elements. Typically, the roofing material is constructed of a substrate such as a glass fiber mat or an organic felt, an asphalt coating on the substrate, and a surface layer of granules embedded in the asphalt coating.

The typical roofing material construction is suitable under most circumstances. However, sometimes a roofing material is subjected to forceful impacts, such as impacts from hailstones during storms, which may cause significant damage to the roofing material. For instance, the force of the impact may cause a puncture or tear in the roofing material. Accordingly, there is a need for a roofing material having improved impact resistance.

Several patents disclose asphalt roofing materials constructed with multiple substrates. For example, U.S. Pat. No. 5,326,797 to Zimmerman et al. discloses an asphalt-coated roofing shingle including a top mat of glass fibers and a bottom mat of polyester. The patent is related to a fire-resistant shingle, and there is no mention of improved impact resistance. Also, there is no suggestion of improved bonding between the polyester mat and the asphalt coating.

U.S. Pat. No. 5,571,596 to Johnson discloses an asphalt-coated roofing shingle including an upper layer of directional fiber such as Kevlar fabric, a middle layer of fibrous mat material such as glass fiber mat, and a lower layer of directional fiber such as E-glass fabric. The upper fiber layer is described as being important to shield the shingle from hail impact damage. The lower layer of E-glass fabric is not effective for improving impact resistance of the shingle.

U.S. Pat. No. 5,822,943 to Frankoski et al. discloses an asphalt-coated roofing shingle including a scrim and a mat. The scrim is bonded to the mat with adhesive; there is no suggestion of improved bonding between the scrim and the asphalt coating. A scrim is not very effective for improving impact resistance of a shingle.

A journal article, "Ballistic Impact Resistance of SMA and Spectra Hybrid Graphite Composites", Journal of Reinforced Plastics and Composites, Vol. 17, 2/1998, by Ellis et al., discloses placing energy absorbing fibers on the back surface of a graphite composite. The fibers were found to provide only a slight improvement in the impact strength of the composite. The journal article is not related to roofing materials.

Thus, the previous literature does not suggest the specific positioning and bonding of a web, and the selection of the right material for the web, to effectively dissipate the energy of impacts on the roofing material.

It is known to manufacture roofing materials with rubber-modified asphalt to provide some improvement in impact resistance. Unfortunately, roofing materials made with rubber-modified asphalt are more difficult to manufacture, handle, store and install, and are more expensive, than roofing materials made with conventional roofing asphalt. Also, the rubber-modified asphalt shingles are not very effective in resisting impacts. Accordingly, there is still a need for a roofing material having improved impact resistance.

SUMMARY OF THE INVENTION

The above objects as well as others not specifically enumerated are achieved by an asphalt-based roofing material according to the present invention. The roofing material includes a substrate coated with an asphalt coating. The asphalt coating includes a lower region that is positioned below the substrate when the roofing material is installed on a roof. A web is fused to the lower region of the asphalt coating. A portion of the web and of the asphalt coating have been intermingled by melting, thereby fusing the web and the asphalt coating.

The present invention also relates to a method of manufacturing the asphalt-based roofing material. The method includes the steps of coating a substrate with an asphalt coating, and applying a web to the lower region of the asphalt coating. A portion of the web and of the asphalt coating are intermingled by melting, thereby fusing the web to the lower region of the asphalt coating. Another embodiment of the method includes the steps of applying a web to a substrate, coating the substrate and the web with an asphalt coating, where the web is in contact with the lower region of the asphalt coating, and intermingling a portion of the web and of the asphalt coating by melting, thereby fusing the web to the lower region of the asphalt coating.

Various objects and advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

Figure 1:
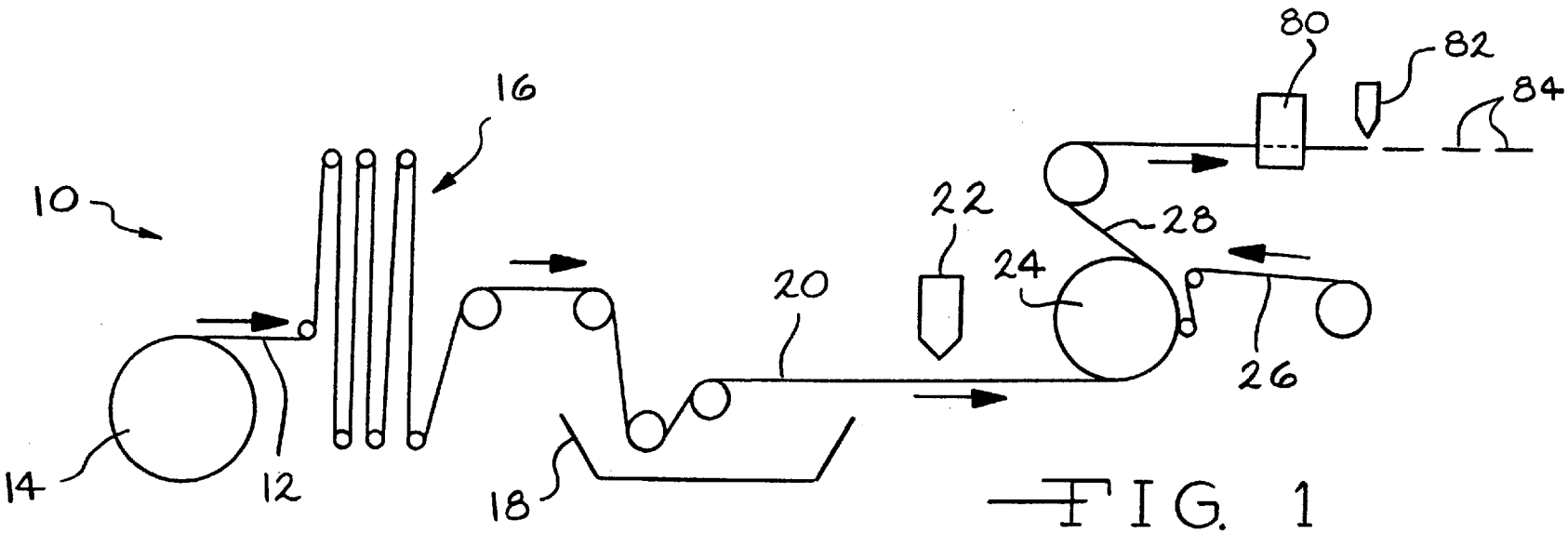
FIG. 1 is a schematic view in elevation of apparatus for manufacturing an asphalt-based roofing material according to the invention.

Referring now to the drawings, there is shown in FIG. 1 an apparatus 10 for manufacturing an asphalt-based roofing material according to the invention. The illustrated manufacturing process involves passing a continuous sheet 12 in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute). Although the invention is shown and described in terms of a continuous process, it should be understood that the invention can also be practiced in a batch process using discreet lengths of materials instead of continuous sheets.

In a first step of the manufacturing process, a continuous sheet of substrate 12 is payed out from a roll 14. The substrate can be any type known for use in reinforcing asphalt-based roofing materials, such as a web, scrim or felt of fibrous materials such as mineral fibers, cellulose fibers, rag fibers, mixtures of mineral and synthetic fibers, or the like. Combinations of materials can also be used in the substrate. Preferably, the substrate is a nonwoven web of glass fibers.

The sheet of substrate is passed from the roll through an accumulator 16. The accumulator allows time for splicing one roll of substrate to another, during which time substrate within the accumulator is fed to the manufacturing process so that the splicing does not interrupt manufacturing.

Next, the sheet is passed through a coater 18 where an asphalt coating is applied to the sheet. The asphalt coating can be applied in any suitable manner. In the illustrated embodiment, the sheet is submerged in a supply of hot, melted asphalt coating to completely cover the sheet with the tacky coating. However, in other embodiments, the asphalt coating could be sprayed on, rolled on, or applied to the sheet by other means. When an organic felt is used as the substrate, it may be desirable to first saturate the felt with a saturant asphalt, and then coat the upper and lower surfaces of the felt with an asphalt coating containing a filler.

The term "asphalt coating" means any type of bituminous material suitable for use on a roofing material, such as asphalts, tars, pitches, or mixtures thereof. The asphalt can be either a manufactured asphalt produced by refining petroleum or a naturally occurring asphalt. The asphalt coating can include various additives and/or modifiers, such as inorganic fillers or mineral stabilizers, organic materials such as polymers, recycled streams, or ground tire rubber. Preferably, the asphalt coating comprises asphalt and inorganic fillers or mineral stabilizers. Unlike some previous roofing materials, there is no need to modify the asphalt with rubber or similar polymers to improve the impact resistance of the roofing material.

The asphalt-coated sheet 20 is then passed beneath a granule dispenser 22 for the application of granules to the upper surface of the asphalt coating. After deposit of the granules, the sheet is turned around a slate drum 24 to press the granules into the asphalt coating and to temporarily invert the sheet.

The asphalt-based roofing material of the present invention includes a web 26 that is selected for the type of web, and that is positioned and bonded in such a manner, as to provide the roofing material with improved impact resistance to a variety of impacts. The improved impact resistance eliminates the occurrence of punctures or tears in the roofing material caused by impacts, and thereby maintains the integrity of the roofing material. The roofing material retains its ability to protect the building from the elements so that, for example, water leaks are avoided. As shown in FIG. 1, the web 26 is payed out onto the lower surface of the sheet 20 while the sheet is inverted on the slate drum 24.

Figure 2:
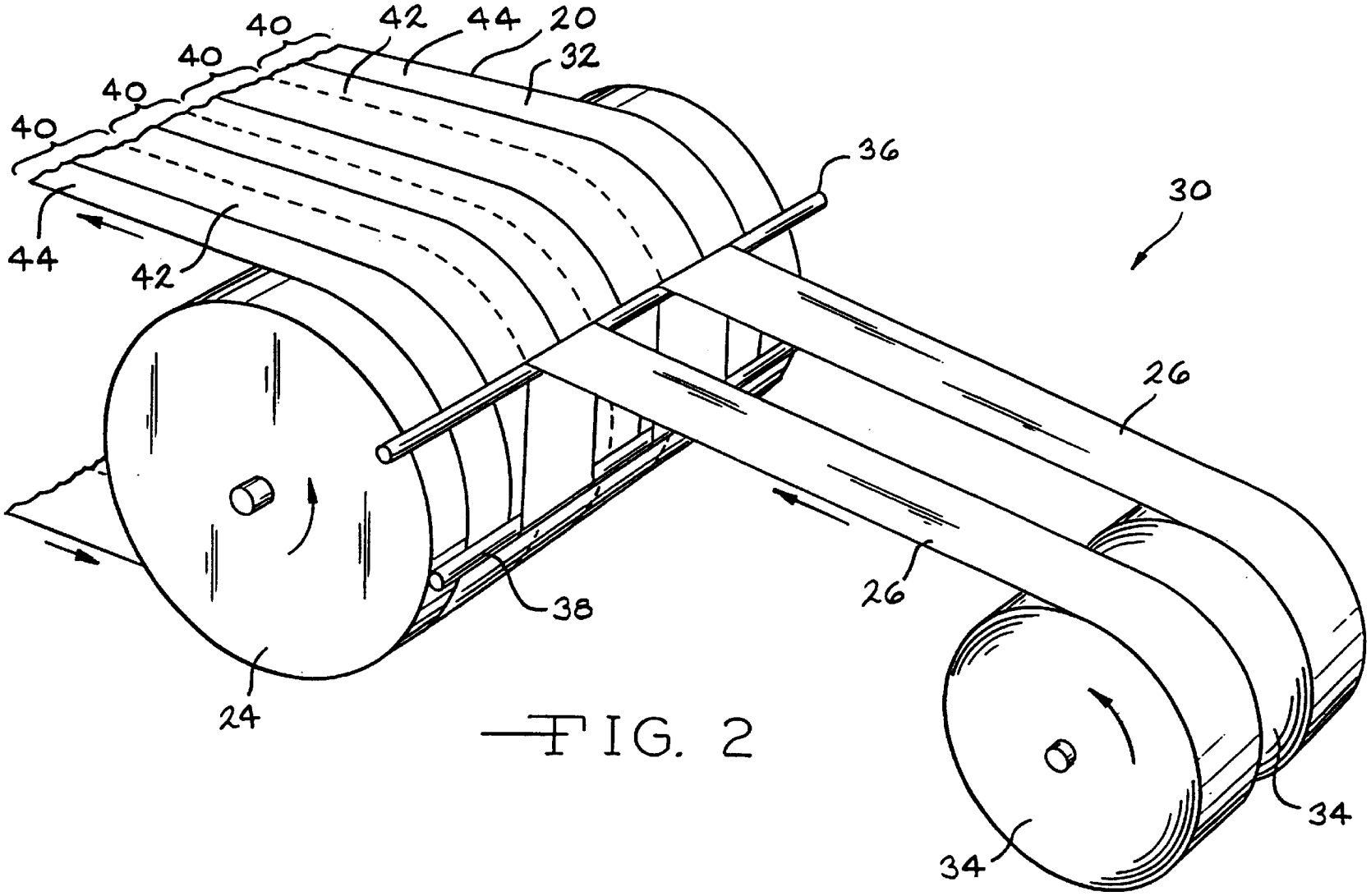
FIG. 2 is a perspective view of part of the apparatus of FIG. 1, showing apparatus for applying webs to the lower surface of a sheet of roofing material.

FIG. 2 illustrates a preferred apparatus 30 for paying out continuous webs 26 onto the lower surface 32 of the sheet 20. The webs are payed out from rolls 34. The webs are fed around first and second guide bars 36 and 38 to maintain tension on the webs. The second guide bar 38 is positioned adjacent and parallel with the slate drum 24, so that the webs are aligned properly with the sheet 20 when they are fed onto the lower surface 32 of the sheet. As the sheet turns around the slate drum, the asphalt coating is still hot, soft and tacky, so that the webs adhere to the lower surface of the asphalt coating and are pulled around the slate drum along with the sheet.

The sheet can include single or multiple lanes. Four lanes 32 are shown in the illustrated embodiment (indicated by the dotted lines), so that the sheet can be cut into roofing shingles. In the illustrated embodiment, each of the lanes 40 includes a prime portion 42 that is normally exposed to the elements when the roofing shingle is installed on a roof, and a headlap portion 44 that is normally covered by adjacent shingles when the roofing shingle is installed on the roof. Preferably, the webs 26 are applied to the lower surface 32 of the sheet in the prime portions, but not in the headlap portions. Application of the web beneath just the prime portion of the roofing material provides improved impact resistance to the portion of the roofing material exposed to the elements on a roof, while minimizing the overall cost of the roofing material.

Figure 3:
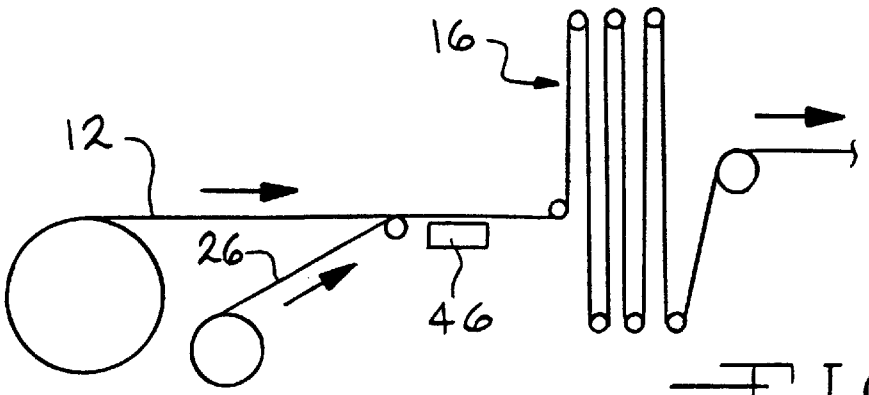
FIG. 3 is a schematic view in elevation of an alternate embodiment of part of the apparatus of FIG. 1, showing apparatus for applying a web to the lower surface of a substrate before coating with asphalt.

In an alternate embodiment shown in FIG. 3, the web 26 is payed out onto the lower surface of the substrate 12 prior to coating both the web and the substrate with asphalt coating. Preferably, the web is bonded to the substrate prior to the asphalt coating step, either intermittently or continuously along their lengths. Any suitable bonding apparatus 46 can be used to bond the web to the substrate. Some examples of bonding methods include heat sealing, ultrasonic welding, pressure sensitive or hot melt adhesive, electrostatic bonding, and physical intertwining by such means as needling or stitching. Bonding the web and substrate together fixes the position of the web relative to the substrate in both the machine and cross directions of the sheet. The bonding also helps to minimize any shrinkage or wrinkling of the web that may occur during the coating step.

Figures 4, 5:
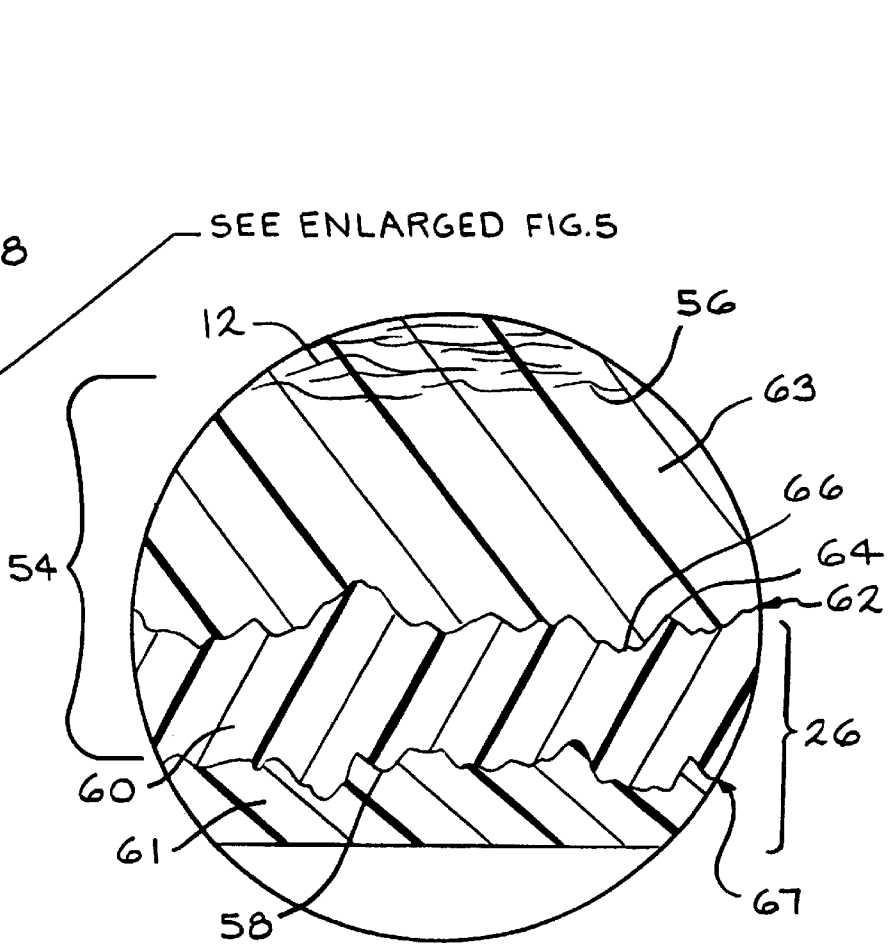
FIG. 4 is an enlarged cross-sectional view of a roofing material according to the invention, including a substrate coated with an asphalt coating and a web fused to the lower surface of the asphalt coating.
FIG. 5 is a further enlarged cross-sectional view of part of the roofing material of FIG. 4, showing a portion of the web that has been intermingled by melting with a portion of the asphalt coating.

As shown in FIGS. 4 and 5, the asphalt-based roofing material 28 includes a substrate 12 that is coated with an asphalt coating 48. A surface layer of granules 50 is embedded in the asphalt coating. The asphalt coating includes an upper region 52 that is positioned above the substrate when the roofing material is installed on a roof, and a lower region 54 that is positioned below the substrate when the roofing material is installed on the roof. For purposes of improved impact resistance, it is important to bond the web 26 to the lower region of the asphalt coating. The bonding of the web to the lower region of the asphalt coating, rather than the upper region, has been found to provide an unexpected improvement in resistance to a variety of impacts. Unlike the roofing shingle disclosed in U.S. Pat. No. 5,571,596 to Johnson, there is no need to add a layer of impact-resistant material to the upper region of the asphalt coating.

The web can be bonded to the asphalt coating at any location in the lower region. The "lower region" 54 of the asphalt coating includes any location between the lower surface 56 of the substrate and the lower surface 58 of the asphalt coating. In the preferred embodiment shown in FIG. 4, the web is bonded to the lower surface of the asphalt coating. It has been found that bonding the web to the lower surface of the asphalt coating achieves a superior impact resistance.

The present invention also provides a strong bond between the web and the asphalt coating, to ensure that the web does not separate from the asphalt coating. If the web separates from the asphalt coating, it is not effective to dissipate the energy of an impact on the roofing material. The strong bond is achieved by fusing the web and the asphalt coating. Specifically, a portion of the web and of the asphalt coating are intermingled by melting, thereby fusing the web and the asphalt coating. "Intermingled" includes any type of physical and/or chemical intermingling of the web and the asphalt coating, to provide a strong mechanical and/or chemical bond.

The illustrated roofing material includes an interphase region 60 where intermingling by melting has occurred between a portion of the web 26 and a portion of the lower region 54 of the asphalt coating, because of the partial miscibility of the melted web and the melted asphalt coating. The interphase region is usually a non-homogenous region including various concentrations of melted asphalt coating, partially or completely melted web, and mixtures of melted asphalt coating and melted web. The interphase region 60 is a different composition from either the remaining portion 61 of the web or the remaining portion 63 of the lower region 54 of the asphalt coating. Thus, the intermingling can include varied degrees of mixing between the web and the asphalt coating. In the illustrated embodiment, the intermingling also includes an irregular interface 62 or boundary between the interphase region 60 and the pure asphalt coating 63. The irregular interface 62 is comprised of peaks 64 and valleys 66 that have resulted from interpenetration between the interphase region and the pure asphalt coating. The irregular interface enhances the bond between the web and the asphalt coating. A portion 61 of the web 26 may have no intermingling with the asphalt coating, thereby forming an interface 67 between the interphase region 60 and the portion 61 of the web.

In a preferred embodiment, the fusing of the web and the asphalt coating is facilitated by the use of a two-component web. The two-component web is comprised of a first component having a first melting point, and a second component having a second melting point that is lower than the first melting point. During the manufacture of the roofing material, at least a portion of the second component is intermingled with the asphalt coating by melting, thereby fusing the web and the asphalt coating. "At least a portion" means that some or all of the second component is intermingled with the asphalt coating by melting. Some portion of the first component may also be intermingled by melting, so long as the web maintains enough of its structure to be effective to improve the impact resistance of the roofing material.

Preferably, the second component has a melting point at least about 50° F. (28° C.) lower than the melting point of the first component, and more preferably at least about 100° F. (56° C.) lower. The asphalt coating usually has a processing temperature within the range of between about 325° F. (163° C.) and about 450° F. (232° C.). Preferably, the second component has a melting point not higher than about 400° F. (204° C.), and more preferably not higher than about 385° F. (196° C.), so that at least a portion melts in contact with the asphalt coating. Preferably, the first component has a melting point not lower than about 350° F. (177° C.) so that it remains substantially solid in contact with the asphalt coating.

Figure 7:
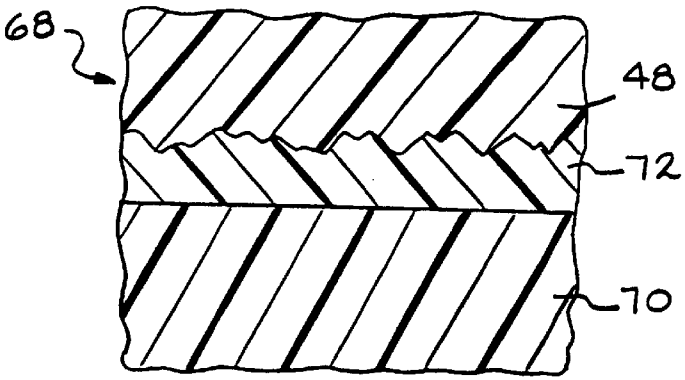
FIG. 7 is a further enlarged cross-sectional view of the film of FIG. 6 in contact with an asphalt coating, showing the second component of the film intermingled by melting with a portion of the asphalt coating.
Figure 6:
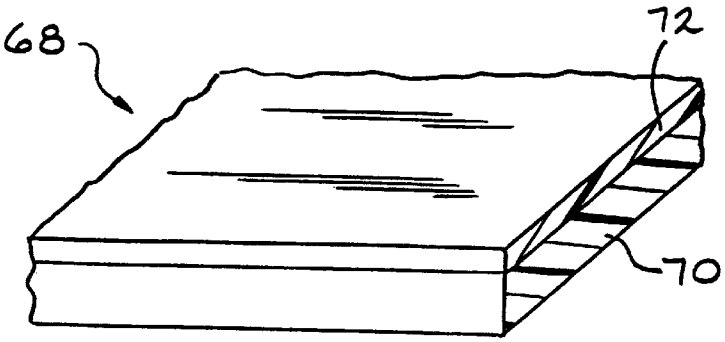
FIG. 6 is an enlarged perspective view of a two-component film useful as a web in an asphalt-based roofing material according to the invention.

FIGS. 6 and 7 illustrate a two-component film 68 that is useful as the web. As shown in FIG. 6, the film comprises a first layer 70 of a first component laminated to a second layer 72 of a second component. As shown in FIG. 7, the second layer 72 has been intermingled with the asphalt coating 48 by melting.

Figure 9:
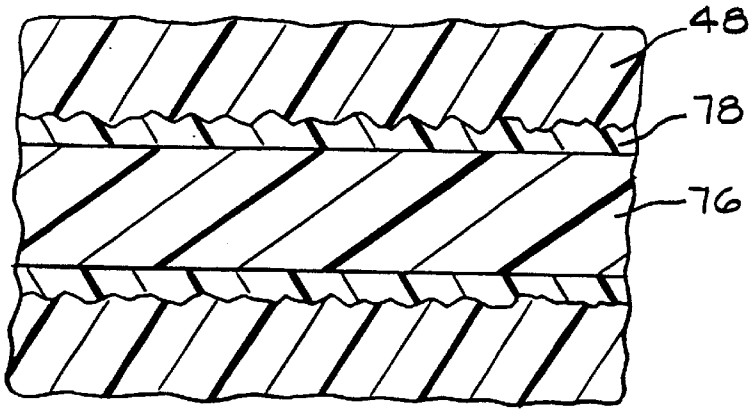
FIG. 9 is a further enlarged cross-sectional view of the sheath/core fiber of FIG. 8 surrounded by an asphalt coating, showing the sheath of the fiber that has been intermingled by melting with a portion of the asphalt coating.
Figure 8:
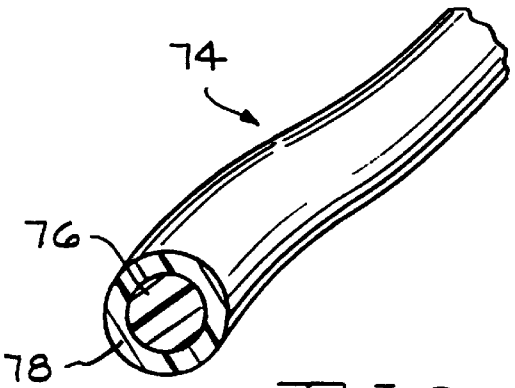
FIG. 8 is an enlarged perspective view of a sheath/core fiber of a web for use in an asphalt-based roofing material according to the invention.

In another embodiment, the web is comprised of two-component fibers. Preferably, the two-component web is a nonwoven web of sheath/core fibers. As shown in FIG. 8, a sheath/core fiber 74 includes a core 76 comprised of a first component, and a sheath 78 comprised of a second component having a lower melting point than the melting point of the first component. As shown in FIG. 9, the sheath 78 has been intermingled with the asphalt coating 48 by melting.

A variety of different types of web are suitable for use in the present invention. The material and structure of the web are chosen so that the web is effective to improve the impact resistance of the roofing material. Specifically, the web is effective to dissipate the energy of an impact on the roofing material. Preferably, the material of the web has good tensile flexure properties, so that it can dissipate the impact energy. A glass mat is unsuitable for use as the web because of its limited elongation properties. Also preferably, the structure of the web is substantially continuous along its length and width so that it can transmit energy waves uninterrupted from the point of impact to the edges of the web. For this reason, a scrim is not preferred for use as the web.

The web is a material which has components that can fuse to the asphalt coating by having a portion of the web melt and intermingle with the asphalt coating. Thermoplastic polymer components are preferred for use in the web because they are capable of partially melting in contact with the hot asphalt coating. On the other hand, thermoset polymer components will not melt in contact with the coating. Usually, the web material is at least partially miscible with the asphalt coating.

Preferably, the web can be cut cleanly and easily during the roofing material manufacturing process, such as when the sheet of roofing material is cut into shingles and when the tabs are cut in a shingle. The clean cutting means that no strings or other portions of the web material are seen protruding from the edges of the cut roofing material.

It is preferred that the web does not substantially shrink in contact with the hot asphalt coating, thus providing total surface coverage. Also preferably, the material of the web has a coefficient of friction that prevents the roofing material from sliding off a roof during installation.

Some materials that may be suitable for use as the web include mats, webs, films, fabrics, veils, scrims, similar structures, or combinations of these materials. The mats include, for example, airlaid spunbonds, netting, and hydroentangled fibers. The films include, for example, rigid polyvinyl chloride, flexible polyvinyl chloride, polycarbonate, ionomer resin (e.g., Surlyn®, and polyvinylidene chloride (e.g., Saran Wrap®).

A preferred material for use as the web is a nonwoven web of twocomponent thermoplastic polymer fibers, such as the sheath/core fibers described above. Preferred webs of sheath/core fibers are commercially available from PGI Inc., 1301 E. 8th St., North Little Rock, Ark. 72114. For example, PGI 4103, PGI 4124 and PGI 4104 are nonwoven webs of sheath/core fibers, each fiber including a core of polyethylene terephthalate and a sheath of polyethylene. The sheaths of the fibers are heat bonded together in the web to hold the web together. These products are available in a variety of nonwoven forms, including lofted and densified forms. A preferred form is densified to 1.0 ounce per square yard (33.9 grams per square meter). The web of sheath/core fibers fuses well to the asphalt coating.

The web can be applied and fused to the lower region of the asphalt coating in any suitable manner. As described above, the preferred method is to coat the substrate with the asphalt coating, and then to apply the web to the lower surface of the coating. A portion of the web melts in contact with the hot asphalt coating and, because of the partial miscibility of the web and the coating, intermingles with the coating to fuse the web and the coating. It has been found that some types of web melt better if they are applied to the asphalt-coated sheet, instead of first being applied to the substrate and then coated along with the substrate. Some types of web will melt too well in the asphalt coater, which may cause them to shrink or tear.

Another method of fusing the web and the asphalt coating is to apply a web that does not initially melt in contact with the coating, but that is partially melted and intermingled with the coating later in the process by applying heat to the web and/or the coating. Another method is to extrude a molten film of the web material onto the lower surface of the asphalt-coated sheet, and then to solidify the web by cooling. Another method is to apply a web to the asphalt-coated sheet, where the web is fully miscible with the asphalt coating, but where the heat history of the web limits the migration of the web into the asphalt coating. Still another method is to mix the material of the web with the asphalt coating during manufacture of the coating; when the asphalt coating is heated in the coater, the material of the web separates and migrates to the surface of the asphalt coating. Other suitable methods are also envisioned.

It should be noted that the web can be manufactured separately before the shingle manufacturing process, or it can be manufactured simultaneously with manufacturing the shingle. It should also be noted that release tapes can be incorporated into part of the web to facilitate separation of the roofing shingles from one another after packaging and shipping. Alternatively, a release material such as silicone can be integrated into the web in parts of the web.

Referring again to FIG. 1, after the web 26 is applied, the sheet of asphalt-based roofing material 28 is reinverted, and then cooled by any standard cooling apparatus 80, or allowed to cool at ambient temperature. The cooling hardens the asphalt coating and the melted portion of the web, thereby setting the bond between the asphalt coating and the web.

The sheet of asphalt-based roofing material 28 is then cut by a cutting apparatus 82 into individual shingles 84, into pieces to make laminated shingles, or into suitable lengths for commercial roofing or roll roofing. The roofing is material is then collected and packaged.

Figure 11:
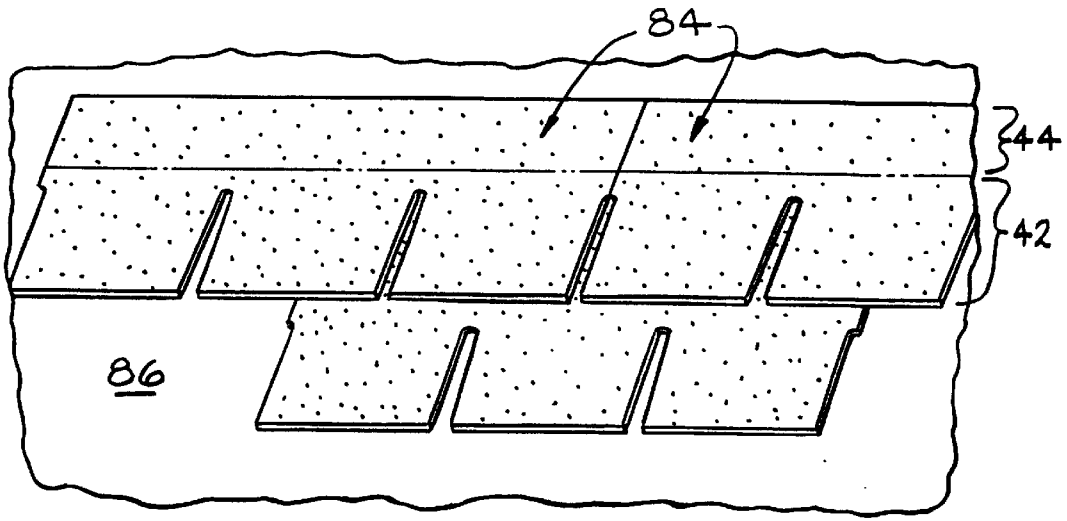
FIG. 11 is a perspective view of several three-tab roofing shingles according to the invention installed on the side of a roof.
Figure 10:
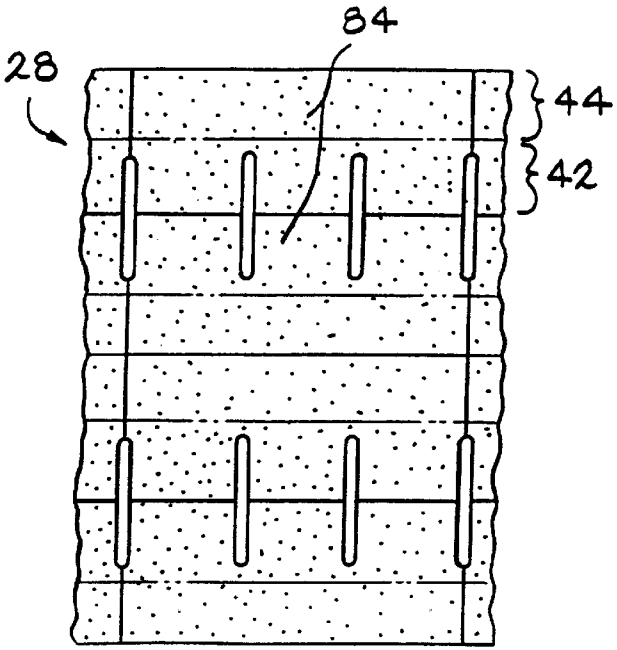
FIG. 10 is a top view of a sheet of roofing material manufactured with the apparatus of FIG. 1, showing the roofing material after being cut but before separation into roofing shingles.

FIG. 10 illustrates the sheet of roofing material 28 after it has been cut into three-tab roofing shingles 84 but before separating the shingles from the sheet. FIG. 11 illustrates several roofing shingles 84 installed on the side 86 of a roof. As shown in FIGS. 10 and 11, each roofing shingle includes a prime portion 42 that is normally exposed to the elements when the shingle is installed on the roof, and a headlap portion 44 that is normally covered by adjacent shingles on the roof. The web is positioned beneath the prime portion 42 but not the headlap portion 44 of each shingle.

Figure 12:
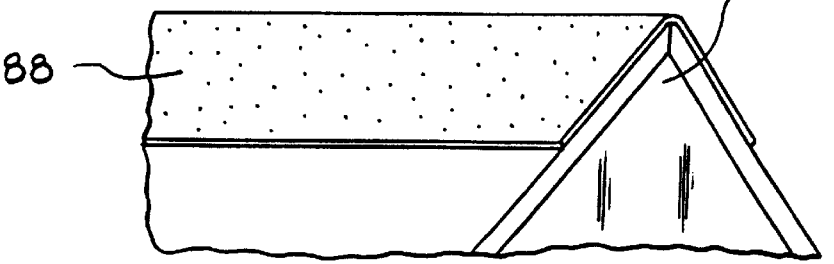
FIG. 12 is a perspective view of a hip and ridge roofing shingle according to the invention installed on the ridge of a roof.

FIG. 12 illustrates a hip and ridge roofing shingle 88 according to the invention installed on the ridge 90 of a roof. The web is positioned beneath the entire shingle because the entire shingle is exposed to the elements on the roof.

Figure 13:
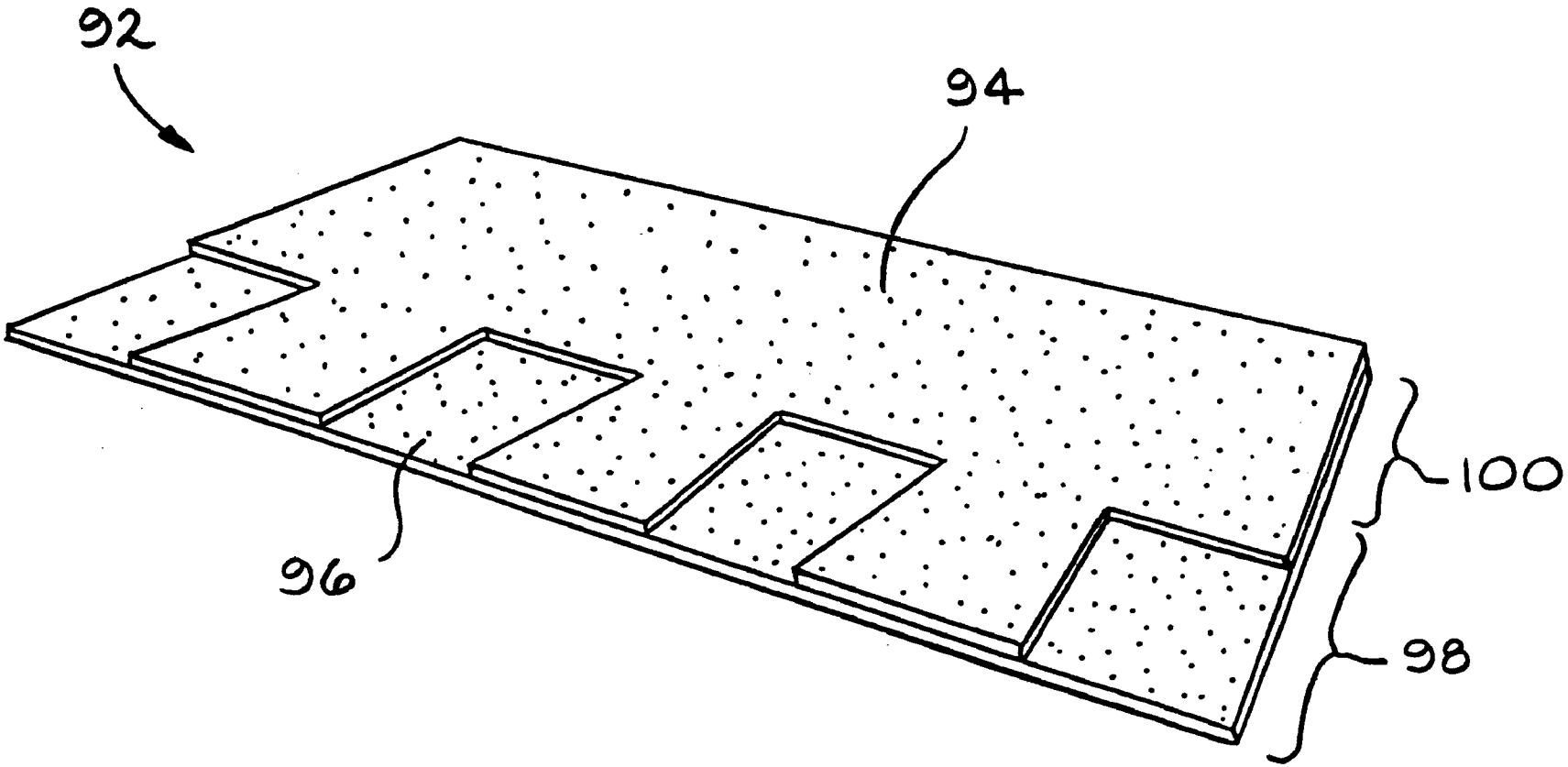
FIG. 13 is a perspective view of a laminated roofing shingle according to the invention.

FIG. 13 illustrates a laminated roofing shingle 92 according to the invention. The laminated shingle is comprised of two pieces of roofing material, an overlay 94 and an underlay 96, which are secured together by adhesive or other means. The laminated shingle includes a prime portion 98 and a headlap portion 100. The web is positioned beneath the prime portion of the underlay but not the headlap portion.

The improved impact resistance of the roofing materials of the present invention is demonstrated by the use of a standard method, UL 2218, "Standard for Impact Resistance of Prepared Roof Covering Materials", Underwriters Laboratories, May 31, 1996. In this method, the roofing material is secured to a test deck, and a steel ball is dropped vertically through a tube onto the upper surface of the roofing material. The roofing material can be tested at four different impact force levels: Class 1 (the lowest impact force) through Class 4 (the highest impact force). The force of impact in the different classes is varied by changing the diameter and weight of the steel ball, and the distance the ball is dropped. For example, the Class 1 test uses a steel ball having a diameter of 1.25 inches (32 mm) weighing 0.28 pounds (127 g) that is dropped a distance of 12 feet (3.7 m), while the Class 4 test uses a steel ball having a diameter of 2 inches (51 mm) weighing 1.15 pounds (521 g) that is dropped a distance of 20 feet (6.1 meters). After the impact, the roofing material is inverted and bent over a mandrel in both the machine and cross directions, and the lower surface of the roofing material is examined visually for any evidence of an opening or tear. A 5× magnification device may be used to facilitate the examination of the roofing material. If no evidence of an opening is found, the roofing material passes the impact resistance test at the UL 2218 class tested. Preferably, a roofing material having a web according to the present invention has an increased impact resistance of at least two UL 2218 classes compared with the same roofing material without the web. More preferably, the roofing material meets a UL 2218 Class 4 impact resistance standard.

The principle and mode of operation of this invention have been described in its preferred embodiments. However, it should be noted that this invention may be practiced otherwise than as specifically illustrated and described without departing from its scope. For example, although the invention is mainly described in terms of resistance to impact from hailstones, the web may also provide improved resistance to other types of impact on the roofing material. The roofing material according to the invention includes any type of roofing material, such as shingles with or without tabs, laminated shingles of various designs, commercial roofing and roll roofing. The invention is intended to be applicable to any current or future designs of roofing materials.

What is claimed is:

1. An asphalt-based roofing material comprising:

a substrate coated with an asphalt coating, the asphalt coating including a lower region that is positioned below the substrate when the roofing material is installed on a roof, and a web fused to the lower region of the asphalt coating, wherein a portion of the web and of the asphalt coating have been intermingled by melting, thereby fusing the web and the asphalt coating.

2. The roofing material of claim 1 in which the web is a two-component web comprised of a first component having a first melting point and a second component having a second melting point, the second melting point being lower than the first melting point, and wherein the intermingled portion of the web comprises at least a portion of the second component.

3. The roofing material of claim 2 in which the second melting point is at least about 50° F. (28° C.) lower than the first melting point.

4. The roofing material of claim 3 in which the second melting point is not higher than about 400° F. (204° C.).

5. The roofing material of claim 2 in which the two-component web is comprised of two-component fibers.

6. The roofing material of claim 5 in which the two-component fibers include a core material as the first component and a sheath material as the second component.

7. The roofing material of claim 6 in which the sheath material has a melting point at least about 50° F. (28° C.) lower than the melting point of the core material.

8. The roofing material of claim 2 in which the two-component web is comprised of a two-component film.

9. The roofing material of claim 1 in which the impact resistance of the roofing material is increased by at least two classes compared with the same roofing material without the web, when tested under impact resistance test UL 2218.

10. The roofing material of claim 1 in which the roofing material is a roofing shingle including a prime portion that is normally exposed when the roofing shingle is installed on the roof, and a headlap portion that is normally covered when the roofing shingle is installed on the roof, and wherein the web is positioned in the prime portion but not in the headlap portion.

11. The roofing material of claim 1 in which the web is comprised of a thermoplastic polymer.

12. The roofing material of claim 1 in which the roofing material is a roofing shingle that is suitable for use on a hip or ridge of a roof.

13. An asphalt-based roofing material comprising:

a substrate coated with an asphalt coating, the asphalt coating including a lower region that is positioned below the substrate when the roofing material is installed on a roof, the lower region including a lower surface, and a web fused to the lower surface of the asphalt coating, wherein a portion of the web and of the asphalt coating have been intermingled by melting, thereby fusing the web and the asphalt coating.

14. The roofing material of claim 13 in which the web is comprised of two-component fibers, the two-component fibers including a first component having a first melting point and a second component having a second melting point, the second melting point being lower than the first melting point, and wherein the intermingled portion of the web comprises at least a portion of the second component.

15. The roofing material of claim 14 in which the second melting point is at least about 50° F. (28° C.) lower than the first melting point.

16. The roofing material of claim 14 in which the two-component fibers include a core material as the first component and a sheath material as the second component.

17. The roofing material of claim 14 in which impact resistance of the roofing material is increased by at least two classes compared with the same roofing material without the web, when tested under impact resistance test UL 2218.

18. A method of manufacturing an asphalt-based roofing material, comprising the steps of:

coating a substrate with an asphalt coating, the asphalt coating including a lower region that is positioned below the substrate when the roofing material is installed on a roof, applying a web to the lower region of the asphalt coating, and intermingling a portion of the web and of the asphalt coating by melting, thereby fusing the web to the lower region of the asphalt coating.

19. The method of claim 18 in which the lower region of the asphalt coating includes a lower surface, and in which the web is applied and fused to the lower surface.

20. The method of claim 18 in which the step of intermingling by melting comprises coating the substrate with the asphalt coating in a melted condition, and applying the web to the lower region of the melted asphalt coating, such that heat from the melted asphalt coating causes a portion of the web to melt and intermingle with a portion of the melted asphalt coating.

21. The method of claim 18 in which the web is a two-component web comprised of a first component having a first melting point and a second component having a second melting point, the second melting point being lower than the first melting point, and wherein the intermingled portion of the web comprises at least a portion of the second component.

22. The method of claim 21 in which the second melting point is at least about 50° F. (28° C.) lower than the first melting point.

23. The method of claim 21 in which the two-component web is comprised of two-component fibers.

24. The method of claim 23 in which the two-component fibers include a core material as the first component and a sheath material as the second component.

25. A method of manufacturing an asphalt-based roofing material, comprising the steps of:

applying a web to a substrate, coating the substrate and the web with an asphalt coating, the asphalt coating including a lower region that is positioned below the substrate when the roofing material is installed on a roof, wherein the web is in contact with the lower region of the asphalt coating, and intermingling a portion of the web and of the asphalt coating by melting, thereby fusing the web to the lower region of the asphalt coating.

26. The method of claim 25 in which the lower region of the asphalt coating includes a lower surface, and in which the web is fused to the lower surface.

27. The method of claim 25 in which the step of intermingling by melting comprises coating the substrate and the web with the asphalt coating in a melted condition, such that heat from the melted asphalt coating causes a portion of the web to melt and intermingle with a portion of the melted asphalt coating.

28. The method of claim 25 in which the web is a two-component web comprised of a first component having a first melting point and a second component having a second melting point, the second melting point being lower than the first melting point, and wherein the intermingled portion of the web comprises at least a portion of the second component.

29. The method of claim 28 in which the second melting point is at least about 50° F. (28° C.) lower than the first melting point.

30. The method of claim 28 in which the two-component web is comprised of two-component fibers.

31. The method of claim 23 in which the two-component fibers include a core material as the first component and a sheath material as the second component.

32. The method of claim 23 comprising the additional step of bonding the web to the substrate before the coating step.

* * * * *